United States Patent [19]

Knudson

[11] Patent Number: 4,570,405

[45] Date of Patent: Feb. 18, 1986

[54] INSULATING APPARATUS DGK FOR PANEL ASSEMBLIES

[76] Inventor: Gary A. Knudson, 17356 W. 57th Ave, Golden, Colo. 80401

[21] Appl. No.: 431,757

[22] Filed: Sep. 30, 1982

[51] Int. Cl.[4] ..... E04D 1/00

[52] U.S. Cl. ..... 52/521; 52/544; 52/403

[58] Field of Search ..... 52/520, 522, 544, 409, 52/410, 442, 478, 86, 521, 528, 545, 402, 403, 404, 468; 49/DIG. 1

[56] References Cited

U.S. PATENT DOCUMENTS

| | | | |
|---|---|---|---|
| 2,590,687 | 3/1952 | Crafton . | |
| 3,191,727 | 6/1965 | Schmeltz | 49/DIG. 1 |
| 3,708,943 | 1/1973 | Thomas | 52/478 |
| 3,967,430 | 7/1976 | Knudson | 52/745 |
| 4,034,532 | 7/1977 | Reinwall, Jr. | 52/520 |
| 4,040,224 | 8/1977 | Harris | 52/509 |
| 4,120,123 | 10/1978 | Knudson | 52/86 |
| 4,135,342 | 1/1979 | Cotter | 52/461 |
| 4,138,808 | 2/1979 | Walkiewicz, Jr. | 52/459 |

FOREIGN PATENT DOCUMENTS

| | | | |
|---|---|---|---|
| 126233 | 11/1945 | Australia | 52/468 |

*Primary Examiner*—Donald G. Kelly
*Assistant Examiner*—Kathryn Ford
*Attorney, Agent, or Firm*—Fields, Lewis, Pittenger & Rost

[57] ABSTRACT

Apparatus and method for heat insulating the inside of a panel assembly (11) forming a building-type structure is disclosed. The insulating apparatus includes anchor clips (31) that are secured in the connecting flange portions of adjacent panels prior to joining them together at continuous seams. These anchor clips are arranged at spaced intervals along the seams and in rows spaced to accommodate standard width of sheets of heat insulation. An intermediate connecting member (33) snap fastens to each anchor clip and preferably is of a good heat insulating material such as an extruded plastic which serves as a thermal barrier between the metal anchor clips (31) and metal retaining members (35). The retaining members snap fasten to each of a row of intermediate connecting members. Spaced pairs of the retaining members (35) extend along and engage the bottom side edge portions of the insulation to support the insulation along, and preferably firmly in place against, the inside of the connecting panels. An alternative retaining member arrangement is a channel-shaped panel with a flat bottom and parallel sidewalls and having end portions that snap-fit into the intermediate connecting members (37) to fully enclose and fully support the insulation.

14 Claims, 6 Drawing Figures

INSULATING APPARATUS DGK FOR PANEL ASSEMBLIES

TECHNICAL FIELD

This invention relates to a novel and improved apparatus for heat insulating panel assemblies.

BACKGROUND ART

Panel assemblies, and particularly interconnected sheet metal panels, have heretofore been used in a variety of building structure applications. Buildings formed of metal panels that are fabricated and assembled at the job site provided many advantages over presently available conventional buildings, as is disclosed in U.S. Pat. No. 3,967,430 of the same inventor as the present invention. Some applications for these metal panel assemblies require insulation from heat and or cold. In the past insulation on the inside walls of a building has been done by blowing cellulose with an adhesive, causing it to stick. The disadvantage of this approach is that the insulation is not attractive, it sheds, there are flash point problems, and this material is sometimes toxic.

Some attempts have been made to secure sheet-type insulation to the building. Knudson U.S. Pat. No. 4,120,123 discloses a heat insulating apparatus wherein a plurality of channel-shaped panels connected side by side are provided with a cap panel interlocked into each seam to enclose bodies of heat insulation on the outside of the building.

Crafton U.S. Pat. No. 2,590,687 discloses an insulating apparatus including an insulation supporting clip having an insulating tube secured to a panel by screws and terminating in an end support member secured to the tube by screws.

Harris U.S. Pat. No. 4,040,224 discloses an insulation retaining device with a tongue portion that inserts between the parallel sidewalls of a joint and has a lip portion at the opposite end to support a body of insulation.

Cotter U.S. Pat. No. 4,135,342 discloses the use of an insulation panel connected along the underside of each supporting panel of a panel assembly with a plurality of clips to attach the insulation panels to the supporting panel.

Walkiewicz U.S. Pat. No. 4,138,808 discloses a retainer strip having oppositely extending flanges which engage and support insulation blankets along the inside of a panel assembly.

DISCLOSURE OF INVENTION

Heat insulating apparatus and method disclosed includes the use of a plurality of anchor clips, each with a hook portion at one end that is secured at spaced intervals and in selected row spacings in the connecting seam of adjacent panels. The hook portion hooks over an inturned flange portion on the upstanding sidewall of one panel, is overlapped by the outturned flange portion of the adjacent panel, and is secured in place when a terminal flange section of the outturned flange portion is folded back under the inturned flange portion to form the connecting seam for the two adjacent panels. An intermediate portion of the anchor clip extends between adjacent sidewalls of the adjacent panels and projects inwardly and terminates in a first snap fastening portion in the form of a flexible hook portion.

An intermediate connecting member, preferably of a good heat insulating material such as extruded plastic, has a second snap fastening portion which connects with the first snap fastening portion of the anchor clip after the panels have been seamed together to suspend the intermediate connecting member from the anchor clip. The anchor clips and attached intermediate connecting members are disposed at spaced intervals along the inside of the connected panels in laterally spaced rows according to the width of the heat insulation being used. Each intermediate connecting member has a third snap fastening portion opposite the second snap fastening portion.

A retaining member has a fourth snap fastening portion connected to the third snap fastening portion whereby they are readily snap-fit together once the connecting members are in place. In one form, the retaining strip is a roll-formed metal strip having oppositely extending flanges which engage to support the adjacent marginal bottom edge portions of two adjacent layers of heat insulation. In another form, the retaining member is a channel-shaped member with snap fastening portions in each upstanding sidewall to provide a pan-type support structure along the entire bottom surface of the insulation.

DETAILED DESCRIPTION

Figure 1:
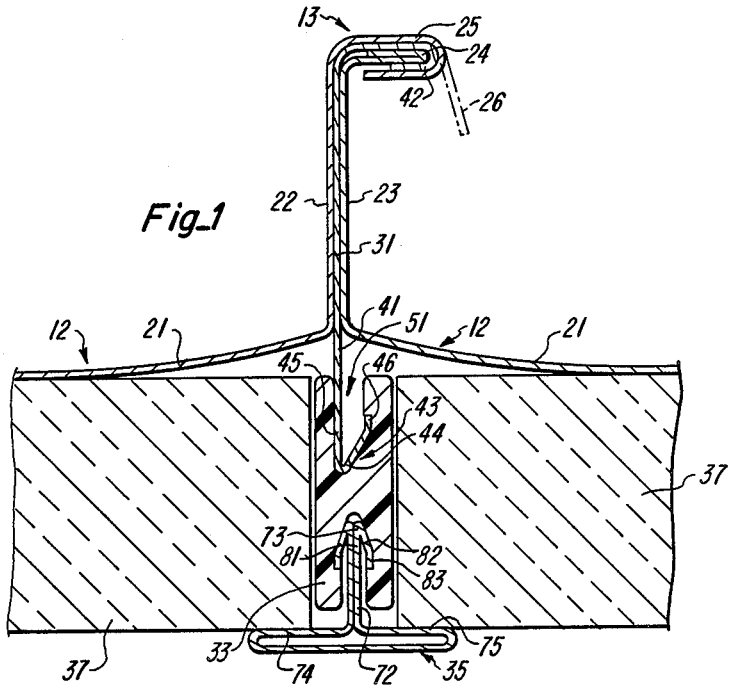
FIG. 1 is a cross-sectional view of apparatus embodying features of the present invention on a curved panel assembly.
Figure 2:
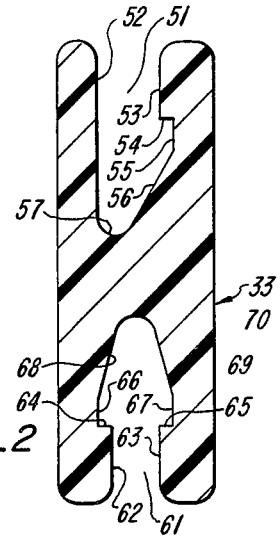
FIG. 2 is an enlarged cross-sectional view of the intermediate connecting member of the apparatus shown in FIG. 1.

Referring now to the drawings, there is shown a curved or arched panel assembly 11 made up of a plurality of identical longitudinally curved panels 12 with adjacent of these panels having interfitting side edge fastening flange portions joined at continuous seams 13. The details of the panel assembly, panels and seams are disclosed in more detail in U.S. Pat. No. 3,967,430.

As shown, the curved panels 12 have a downwardly curved intermediate or bottom portion 21 and a pair of opposed upright sidewall portions 22 and 23. An inturned male edge fastening flange portion 24 is a flange extending laterally out from the upper end of the sidewall portion 23 and has the sheet metal bent back to a double thickness, and an outturned female edge fastening flange portion 25 is initially formed in the shape of an inverted channel into which male portion 24 will insert and nest. The channel has a depending terminal section 26 opposite and spaced from sidewall portion 23. The terminal section 26 is initially formed to extend outwardly and downwardly to permit portion 24 to insert directly thereinto, as shown in dashed lines, and is folded under portion 24 by seaming apparatus to connect the panels together at the seam 13.

The retaining apparatus for the insulation shown in FIGS. 1–4 is a three-part assembly which includes anchor clips 31 secured at spaced intervals in selected of the seams 13, an intermediate connecting member 33 snap-fastened to each anchor clip, and a retaining member 35 in the form of a strip extending the full length of the panel assembly that snap-fastens to a row of the connecting members 33. Laterally spaced pairs of the retaining member 35 are shown supporting a body of insulation 37 in the form of a flexible sheet of the required thickness and RH factor.

The anchor clip 31 further has a male snap fastening portion 43 at the lower end which is also in the form of a flexible hook portion with a bend at the lower end with an inclined return portion 44 that extends back and away from a shank portion 45 at an angle and a terminal section 46 that is parallel to the shank portion 45. The inclined portion 44 and terminal section 46 flex inwardly when lateral pressure is applied thereto and return to the orginal position when the pressure is removed.

The intermediate connecting member 33 shown is made from an oblong block having a generally rectangular cross section. Connecting member 33 has a female snap fastening portion 51 formed in its top face which takes the form of an inwardly extending groove in the top of the block, providing a female socket into which the hook portion 43 above described will slidably insert when a suitable force is applied thereto. The female snap fastening portion 51 is generally complementary in shape to the male snap fastening portion and is defined by straight inner sidewalls 52 and 53 which form the neck or a restriction of the socket.

Sidewall portion 52 extends the full length and sidewall portion 53 is interrupted by a step 54 which forms a stop or abutment to hold the male portion 43 against being pulled directly out from the female portion 51. The intermediate connecting member 33 can be removed by sliding it along and off either end of the anchor clip. A wider sidewall portion 55 accommodates the terminal section 46, an inclined sidewall portion 56 accommodates the inclined hook portion 44, and a curved portion 57 joins wall portions 52 and 56. Upon insertion of the fastener portion 51 over the hook portion 43, the inclined portion is forced inwardly and springs back to lock in place.

The intermediate connecting member 33 has another female snap fastening portion 61 recessed in its bottom face which also takes the form of an inwardly extending groove. This female socket portion 61 is defined by straight inner sidewalls 62 and 63 which form the neck of the socket and from which extend oppositely extending steps 64 and 65, respectively, which form a stop or abutment to hold the retaining strip in place in the body. Wider sidewalls 66 and 67 merge with inclined surfaces 68 and 69 and surfaces 68 and 69 merge at a centrally disposed curved surface 70.

The retaining member 35 is generally of an inverted T-shape and has a straight intermediate portion 72, a male snap fastening portion 73 at the upper end, and a pair of opposed outwardly extending flange portions 74 and 75 at the lower end.

The male snap fastening portion 73 takes the form of two similarly shaped flexible hook portions 77 and 78 arranged back to back. Each hook portion has a straight shank portion 81, an inclined return portion 82, and a terminal section 83, and flexes inwardly as it is inserted and snap-fastens into the socket 61 in the same way as hook portion 43 above described. The retaining members 35 extend the full length of the insulation that is being supported.

This insulation retaining arrangement is particularly suited for the curved or arched panel which forms both the roof and opposed sidewalls of a building in a continuous span because it snugs the insulation up against the inside of the panel and causes the insulation to flex to conform to the shape of the panel assembly. In this way the insulation is held firmly in place. The apparatus will accommodate layers of different thickness by changing the depth of the intermediate portion 72 of the retainer member.

In practice the standard insulation sheets would be 4 feet by 4 feet or 4 feet by 8 feet. The width of the connected panels at the seams would be 1 foot and for this system the anchor strips would preferably be 4 inches in length and spaced apart at 4-foot centers. It is understood that the apparatus is also well suited for the panel assemblies disclosed in my copending application having panel seams spaced at 16 inches and 24 inches.

The procedure for installing the above described apparatus to heat insulate the assembly of panels 12 includes hooking each hook 42 of the anchor clips on the inturned flange portion of a selected one of the panels 12 prior to assembling them together. The outturned flange portion is placed over the inturned flange portion and the panels are seamed together by turning the terminal section under portions 24 and 42 in the conventional seaming operation. The connecting members 33 are snap-fit on the anchor clips. The retaining members 35 are placed under the side edge portions of the insulation and the members 35 are snapfit into an associated connecting member 33, the insulation being held snugly up against the inside of wall portion 21 of the panel. In this way the insulation is flexed to conform to the curvature of the inside of the building and held snugly thereagainst.

Figure 5:
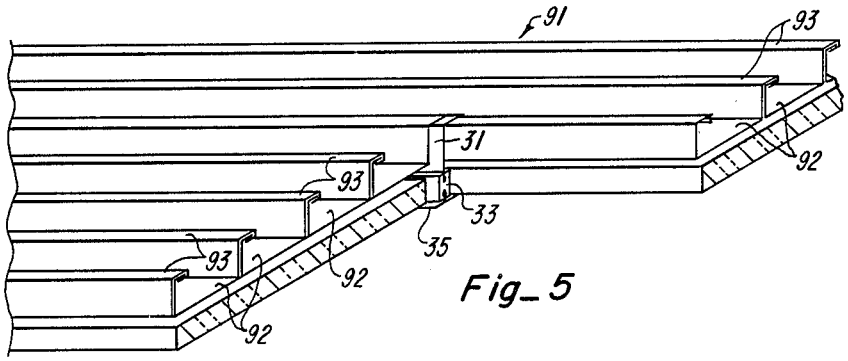
FIG. 5 is a perspective view partially broken away of apparatus embodying features of the present invention on a straight panel assembly.

Referring now to FIG. 5, there is shown a panel assembly 91 comprised of a plurality of straight panel 92 joined at seam 93. A sheet of insulation 37 is shown secured to the panels by members 31, 33 and 35 in the same manner as above described.

Figure 6:
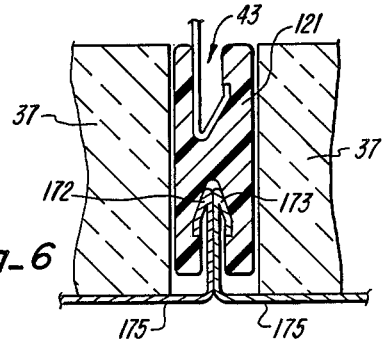
FIG. 6 is a sectional view of another form of retaining member embodying features of the present invention.
Figure 3:
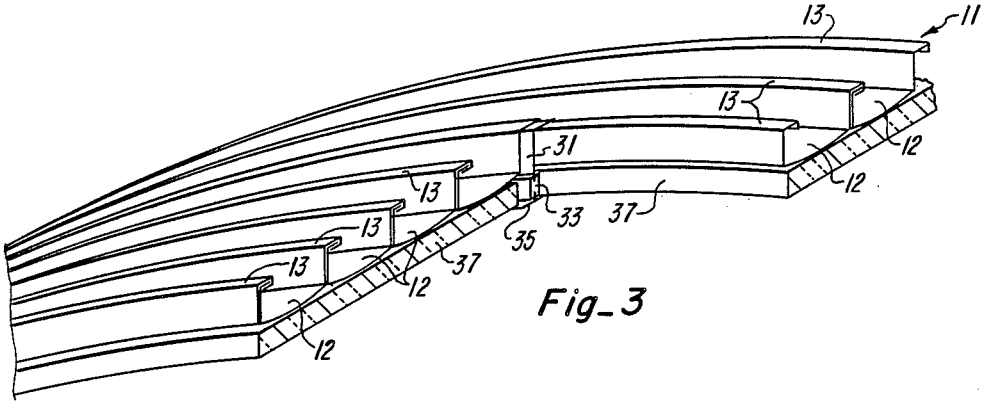
FIG. 3 is a perspective view partially broken away of the apparatus shown in FIG. 1.
Figure 4:
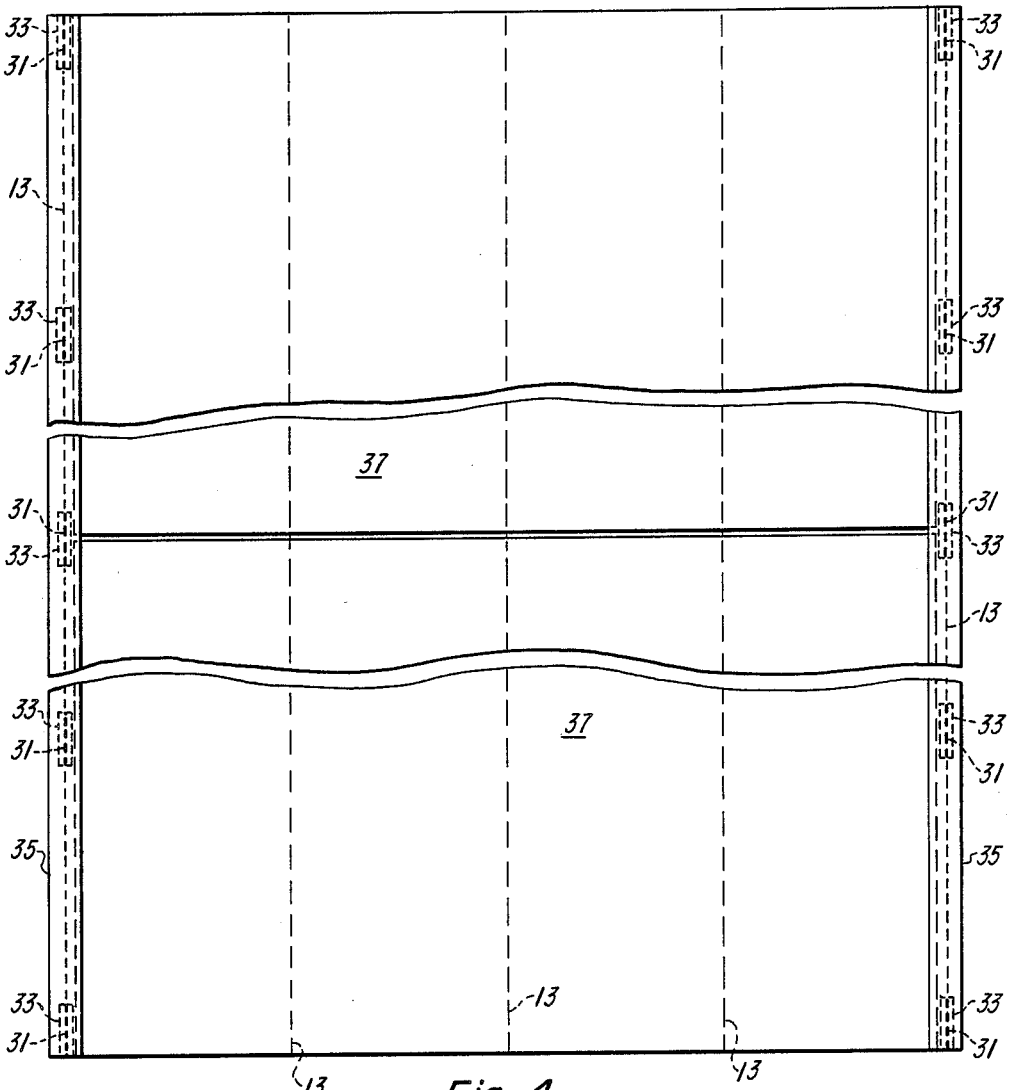
FIG. 4 is an inside plan view of the apparatus shown in FIG. 1.

In FIG. 6 there is shown another form of retaining member wherein the same form of intermediate connecting member 37 is shown receiving male snap fastening portion 43, which receives hooks 172 and 173 formed in the upper edges of a channel-shaped panel 175 to provide a full enclosure and full lateral support for the body of insulation 37.

From the foregoing description it is apparent that some of the advantages of the apparatus and method of the present invention are that no penetration of the building is required, there is provided a solid mechanical means of attaching to the panels without the use of glue or an adhesive, and the apparatus is versatile in supporting and retaining various thicknesses of insulation panels. Finally, there is no special skilled labor or special equipment required to install same.

Although the present invention has been described with a certain degree of particularity, it is understood that the present disclosure has been made by way of example and that changes in details of structure may be made without departing from the spirit thereof.

What is claimed is:

1. In insulating apparatus for a panel assembly including a plurality of side by side panels, adjacent panels having adjacent edge portions joined at seams, the combination comprisng:

rows of spaced anchor clips secured in selected of said seams, each anchor clip extending inwardly from said seams and having a first resilient male snap fastening member in the form of a flexible hook portion with a bend at the lower end and having an inclined return portion which extends back and away from a shank portion at an angle, said return portion having a transverse edge;

an intermediate connecting member having a first female retaining groove for slidably receiving a first male snap fastening member on an associated anchor clip, said retaining groove having a neck narrower than the width of said hook portion through which said hook portion passes and is contracted upon insertion into said retaining groove and a lateral shoulder inwardly of said neck, said hook portion expanding after said transverse edge is inserted past said lateral shoulder to lock said hook portion from being pulled from said retaining groove, whereby each connecting member is readily hand-fastened to the associated anchor clip after said anchor clip is secured in the associatedseam, said intermediate connecting member having a second female retaining groove; and retaining means including laterally inwardly extending support portions on which a body of insulation is supported along the inside of the panel assembly between said rows of anchor members, said retaining means having a second resilient male snap fastening member slidably received by an associated second female retaining groove of an intermediate connecting member and extending along a row of said intermediate connecting members, whereby said retaining member is readily hand-fastened to said connecting member after said connecting member is in place on an associated anchor clip.

2. In insulating apparatus as set forth in claim 1 wherein said retaining means holds said body of insulation snugly against the inside of associated of said panels.

3. In insulating apparatus as set forth in claim 2 wherein said panels are longitudinally curved and said body of insulation is flexed to conform to the shape of the inside of said panels and said retaining means flexes to conform to the curvature of said insulation.

4. In insulating apparatus as set forth in claim 1 wherein each said intermediate connecting member is a body of good heat insulating material which provides a thermal barrier between each anchor clip and the associated retaining member.

5. In insulating apparatus as set forth in claim 1 wherein each anchor clip has a hook portion with a shank section, a bend, and a backturned return section substantially parallel to said shank section at one end arranged transverse to an intermediate portion, said hook portion being hooked over an inturned flange portion on one panel, said intermediate portion extending between adjacent sidewalls of adjacent panels.

6. In insulating apparatus as set forth in claim 1 wherein said retaining means includes a pair of laterally spaced retaining members each having an inwardly extending support portion.

7. In insulating apparatus as set forth in claim 6 wherein each of said retaining members is a strip having a generally inverted T-shape, the lower laterally extending portions supporting the bottom edge portions of adjacent bodies of insulation.

8. In insulating apparatus as set forth in claim 7 wherein said strip is roll-formed into shape from a sheet metal material.

9. In insulating apparatus as set forth in claim 1 wherein said retaining means is in the form of a channel-shaped panel having flexible hook portions extending up from parallel sidewalls of said panel to snap-fit into said intermediate connecting member.

10. In insulating apparatus as set forth in claim 1 wherein said intermediate connecting member is in the form of an oblong block of extruded plastic heat insulating material, said first female retaining groove being in the top and said second female retaining groove being in the bottom.

11. In insulating apparatus as set forth in claim 1 wherein the vertical extent of said retaining means is changed to accommodate insulation of different thicknesses.

12. An insulating apparatus for a panel assembly including a plurality of side by side panels, adjacent panels having adjacent edge portions joined at seams, the combination comprising:

rows of spaced anchor clips secured in selected of said seams, each anchor clip extending inwardly from said seams and having a snap fastening flexible hook at the free end with a bend at the lower end and having an inclined return portion which extends back and away from a shank portion at an angle, said return portion having a transverse edge, each anchor clip being made of a relatively short strip of sheet metal;

an intermediate connecting member in the form of an extruded plastic block having a top retaining groove for slidably receiving and retaining said flexible hook, said retaining groove having a neck that is narrower than the width of said hook through which said hook passes and is contracted upon insertion into said retaining groove and a lateral shoulder inwardly of said neck, said hook expanding after said transverse edge is inserted past said lateral shoulder to lock said hook against being pulled from said retaining groove, whereby each connecting member is readily hand-fastened to the associated anchor clip after said anchor clip is secured in the associated seam, said block further having a bottom retaining groove portion; and retaining means including laterally inwardly extending sheet metal flexible support portions on which a body of insulation is supported along the inside of the panel assembly between said rows of anchor members, said retaining means having a flexible hook slidably received by and retained in said bottom retaining groove whereby said retaining means is readily hand-fastened to said connecting member after said connecting member in in place on an associated anchor clip, said retaining means extending along rows of said intermediate connecting members, said connecting members forming a thermal barrier between said anchor clips and said retaining means.

13. In insulating apparatus for a panel assembly including a plurality of side by side panels, adjacent panels having adjacent edge portions joined at seams, the combination comprising:

rows of spaced anchor clips secured in selected of said seams, each anchor clip extending inwardly from said seams and having a first resilient male snap fastening member, each said anchor clip being made of a strip of sheet metal bent at each end to form a transverse hook portion at the upper end and a flexible hook portion at the lower end;

an intermediate connecting member having a first female retaining groove for slidably receiving a first male snap fastening member on an associated anchor clip, whereby each connecting member is readily hand-fastened to the associated anchor clip after said anchor clip is secured in the associated seam, said intermeidate connecting member having a second female retaining groove; and retaining means including laterally inwardly extending support portions on which a body of insulation is supported along the inside of the panel assembly between said rows of anchor members, said retaining means having a second resilient male snap fastening member slidably received by an associated second female retaining groove of an intermediate connecting member and extending along a row of said intermediate connecting members, whereby said retaining member is readily hand-fastened to said connecting member after said connecting member is in place on an associated anchor clip.

14. In insulating apparatus as set forth in claim 1 wherein each said anchor clip has a transverse flange portion at one end extending from an intermediate portion, said flange portion being seamed between an inturned flange portion on one panel and an outturned flange portion on the other panel that is folded back under said inturned flange portion.

* * * * *